US005764240A

United States Patent [19]

Herz

[11] Patent Number: 5,764,240

[45] Date of Patent: Jun. 9, 1998

[54] METHOD AND APPARATUS FOR CORRECTION OF VIDEO TEARING ASSOCIATED WITH A VIDEO AND GRAPHICS SHARED FRAME BUFFER, AS DISPLAYED ON A GRAPHICS MONITOR

[75] Inventor: William S. Herz, Newark, Calif.

[73] Assignee: S3 Incorporated, Santa Clara, Calif.

[21] Appl. No.: 629,784

[22] Filed: Apr. 9, 1996

Related U.S. Application Data

[63] Continuation of Ser. No. 299,048, Aug. 31, 1994, abandoned.

[51] Int. Cl.[6] ..... G09G 5/00

[52] U.S. Cl. ..... 345/508; 345/512

[58] Field of Search ..... 345/115, 116, 345/185, 183, 133, 189, 196, 201, 213, 508, 512; 348/714, 718, 497, 513, 584, 588, 597; 358/335, 342

[56] References Cited

U.S. PATENT DOCUMENTS 4,231,063 10/1980 Ito et al. ..... 348/513

5,097,257 3/1992 Clough et al. ..... 345/196

5,243,447 9/1993 Bodenkamp et al. ..... 345/116

5,274,753 12/1993 Roskowski et al. ..... 345/116

*Primary Examiner*—Chanh Nguyen

*Attorney, Agent, or Firm*—Fenwick & West LLP

[57] ABSTRACT

A video and graphics display system compensates for video tearing caused by reading graphics data from a shared buffer faster than video data is stored into the shared buffer. The video data is arranged in video fields comprising scan lines of pixel data. A processor determines the scan line of overtake of reading graphics data from the buffer at a rate faster than storing video data of a current video field into the buffer. A generator provides at least one video scan line as an interpolation of at least one scan line of the current video field stored in the shared buffer and of at least one scan line of a previous video field stored in the shared buffer. A multiplexer receives video scan lines from the shared buffer and from the generator and provides the video scan lines from the shared buffer to a display if there is no scan line of overtake and provides the interpolated video scan lines from the generator to the display if there is a scan line of overtake.

14 Claims, 4 Drawing Sheets

METHOD AND APPARATUS FOR CORRECTION OF VIDEO TEARING ASSOCIATED WITH A VIDEO AND GRAPHICS SHARED FRAME BUFFER, AS DISPLAYED ON A GRAPHICS MONITOR

"RELATED APPLICATIONS

This is a continuation of application Ser. No. 08/299,048 filed on Aug. 31, 1994, now abandoned."

FIELD OF THE INVENTION

This invention relates to simultaneously displaying video and graphics information on a common display, and more particularly, to correcting the video tearing associated with a video and graphics shared frame buffer.

BACKGROUND OF THE INVENTION

Video information is commonly displayed in a video window on a graphics display. For a raster scan display, the image is displayed by a sweep of picture elements (pixels) in lines from left to right and from top to bottom. In some video-graphics systems, both video data and graphics data are stored in a shared frame buffer. However, when both video and graphics are displayed, typically either the video being displayed may roll or a line or tear appears in the video and rolls from frame to frame. This problem is called asynchronization. Asynchronization typically occurs because of variations in phase and timing of the synchronization rates between the two types of displayed information. Asynchronization is frequently corrected by matching the phase and the frequency of the graphics and video. However, another problem frequently occurs while using such a technique for correction.

This other problem is a shift between the displayed video image in an upper portion of the window and the displayed video image in a lower portion of the window, which occurs because video data is stored into the shared frame buffer at a rate that is slower than the rate that graphics data is read from the buffer. For example, a PC graphics display may use a display of 1280 pixels×1024 pixels×2 bytes or larger. The video field may be 640 pixels×240 pixels×2 bytes or larger and may be scaleable. Typically, the video data is stored into the shared frame buffer at a real time video capture rate or, for this example, at a rate of 640×240×2 bytes per 1/60 second. Conversely, the graphics data may be read from the shared frame buffer at a faster rate of 1280×1024×2 bytes per 1/60 second.

Consequently, the reading of the shared frame buffer may overtake the storing of the video in the shared frame buffer, under circumstances dependent on the size and position of the video window. As the video information is displayed in the video window, the viewer sees the current video until overtaking occurs. At such an overtake, the video display exhibits a shift between the image above the scan line of the overtake and the image below the scan line of the overtake. The severity of the shift is dependent on the motion between the video fields. Similarly, the position of the shift is dependent on the graphics resolution, the video resolution, the size of the video window, and the position of the video window. This shift is referred to as video tearing.

One approach for eliminating video tearing is to provide sufficient frame buffer capacity to store the entire prior video field. With such capacity, reading of graphics display data from the frame buffer does not interfere with the storing to the buffer because the video information is already in the buffer. Accordingly, in such a system, the storing of the video data in the buffer always leads the reading of the graphics data from the buffer. However, this solution is expensive because video random access memory (VRAM) for the buffer is costly.

Another approach for eliminating video tearing is to determine the "golden phase relationship" between the graphics data and the video data by phasing the graphics data in advance so that the video window data of the previous frame is already displayed before the current video is stored in the shared frame buffer. This approach requires that, for every video window size and position, the golden phase must be calculated. Moreover, the change of the phase to the calculated value causes the image to temporarily lose synchronization to thereby cause the displayed image to roll or black out.

It is therefore desirable to eliminate video tearing by using less costly sizes of memory. It is also desirable to eliminate video tearing by minimizing the processing of data and to minimize the loss of synchronization while displaying such data.

SUMMARY OF THE INVENTION

In accordance with the present invention, an apparatus provides video and graphics data to an external display system, which comprises a monitor, a graphics processor for generating graphics data, a memory coupled to the graphics processor for storing the graphics data at a selected rate and for storing video data from an external video source at a selected rate, and a multiplexer. The video data is arranged in video fields comprising scan lines of pixel data. The multiplexer has a first input coupled to the memory, a second input, and an output coupled to the monitor for supplying the data applied to the first input, in response to a selection signal having a first logic state, and for supplying data applied to the second output, in response to a selection signal having a second logic state. The apparatus comprises a control processor and a generator. The control processor has a first input coupled to the external video source and a second input coupled to the graphics processor. The control processor determines a scan line of overtake of reading graphics data from the memory at a rate faster than storing video graphics data into the memory. The control processor generates the selection signal having the first logic state indicative of no scan line of overtake and the second logic state indicative of a scan line of overtake. The generator has an input coupled to the external video source and an output coupled to the second input of the multiplexer. The generator supplies at least one scan line of video data from the current video field stored in the memory and of at least one scan line of video data from a previous video field stored in the memory.

DETAILED DESCRIPTION

Figure 1:
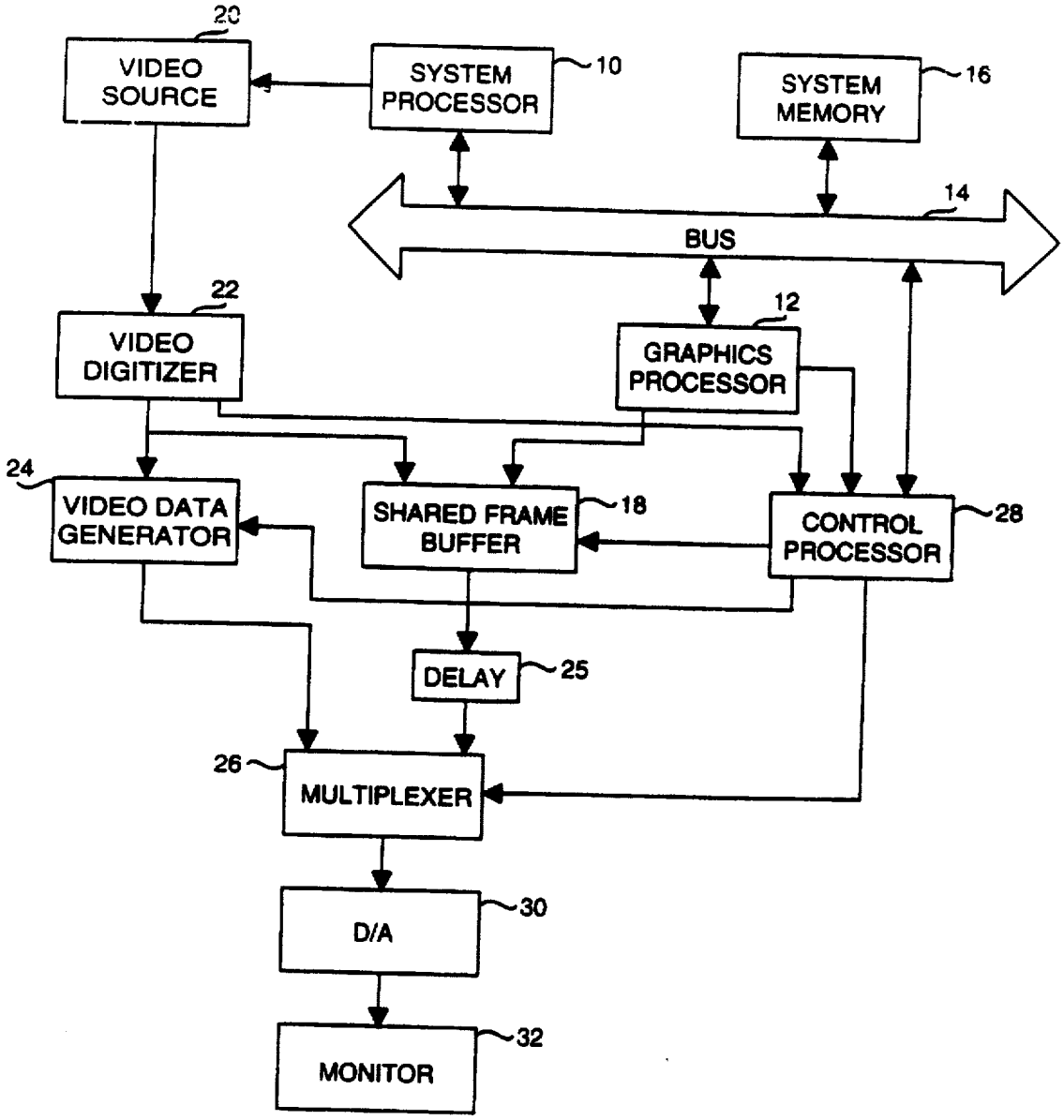
FIG. 1 is a block diagram of a display system for correcting the video tearing displayed on a graphics monitor that is associated with a shared frame buffer for storing both video and graphics data according to principles of the invention.

Referring to FIG. 1, there is illustrated a block diagram of a display system for simultaneously displaying video and graphics data. In response to commands from a system processor 10, for example, of the 80486 type manufactured by Intel Corporation of Santa Clara, Calif., a graphics processor 12 reads data via a system bus 14 from a system memory 16, generates graphics data from the data read from the system memory 16, and stores the graphics data in a shared frame buffer 18. The graphics processor 12 may be, for example, an 86C928 graphical user interface (GUI) accelerator manufactured by S3, Inc. of Santa Clara, Calif. The shared frame buffer 18 may be, for example, a conventional video random access memory (VRAM). The size of the shared frame buffer 18 is dependent on the resolution of the video data, the format of the video data, the resolution of the graphics data, and the format of the graphics data. The number of bytes per pixel (picture element) of video data is dependent on the video format. For example, the number of bytes per pixel is 3 bytes (24 bits) for an RGB video format and 2 bytes (16 bits) for a Y, $C_R$, $C_B$ video format. The number of bytes per pixel of graphics data is dependent on the graphics format. The number of bytes per pixel is typically 2 or 3 bytes.

In response to control signals from the system processor 10, a video source 20 provides a video signal to a video digitizer 22 that converts the video signal into digital video data and stores the digital video data in the shared frame buffer 18. The video source 22 may be, for example, a video camera, a video tape player, a video disk player, and the like. The video digitizer may be, for example, a type SAA7110 digitizer manufactured by Philips. Alternatively, a digital video source may be used instead of the video source 20 and the video digitizer 22. The video digitizer 22 also provides digital video data to a video data generator 24, later described herein, for generating video data as an interpolation of video data from consecutive video fields.

The shared frame buffer 18 provides video data through a delay circuit 25 to a first input of a multiplexer 26. The video data generator 24 provides interpolated video data, later described herein, to a second input of the multiplexer 26. A control processor 28 receives via the bus 14 from the system processor 10 the size and the position of the video window, the resolution of the graphics, and the resolution of the video. The graphics processor 12 generates graphics synchronization signals for identifying the timing for displaying the graphics data and provides these signals to the control processor 28. In a similar manner, the video digitizer 22 generates video synchronization signals for identifying the timing for displaying the video data and provides these signals to the video processor 28. As described later herein, the control processor 28 controls the reading of data from the shared frame buffer 18 and the operation of the video data generator 24. The control processor 28 provides a compensation signal to the multiplexer 26 for selecting whether interpolated video data from the video data generator 24 or video data from the shared frame buffer 18 is to be provided to a digital-to-analog converter 30. The digital-to-analog converter 30 transforms the digital data from the multiplexer 26 into a display format for displaying on a monitor or display 32. The digital-to-analog converter 30 may be, for example, a DAC485 manufactured by Brooktree.

Figure 2:
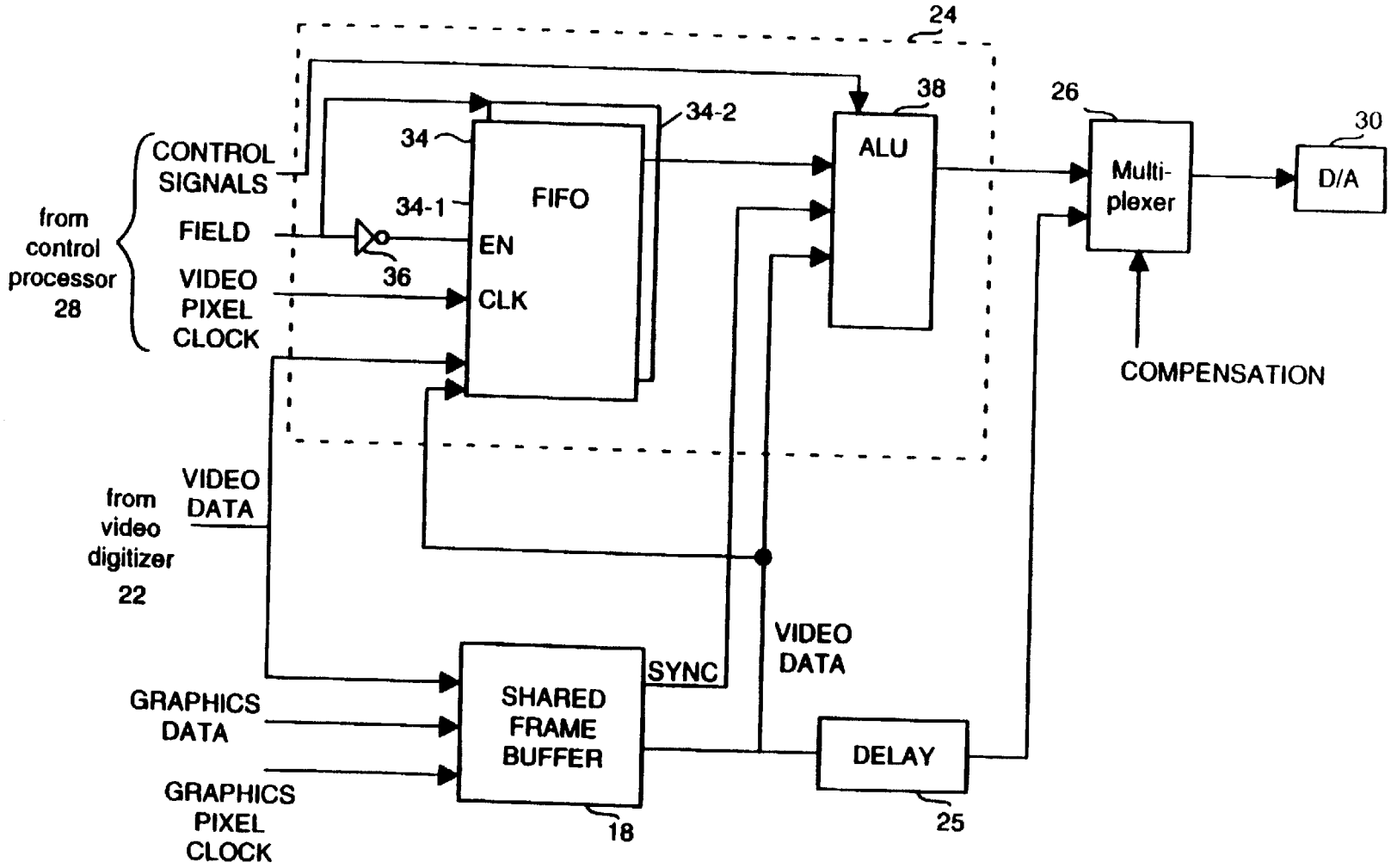
FIG. 2 is a schematic diagram of a video data generator for providing scan lines of video data that interpolate the scan lines of video data for successive fields.

Referring to FIG. 2, there is illustrated a schematic diagram of the video data generator 24. Video data from the video digitizer 22 is applied to a scan line buffer 34 and to the shared frame buffer 18. The size of the scan line buffer 34 is dependent on the number of scan lines of video data used for interpolation, the format of the video data, the format of the graphics data, the resolution of the video data, and the resolution of the graphics data. The scan line buffer 34 may be a plurality of conventional First In-First Out memories (FIFOs) 34-1, -2. Each FIFO is preferably 1024 bytes. For clarity, only two FIFOs are shown. For interlaced video scan lines, video data is stored in and read from pairs of FIFOs in a "ping-pong" manner. In particular, for a National Television System Committee (NTSC) format, the video data is stored in FIFOs 34-1, -2 for odd and even fields, respectively. The control processor 28 provides a field select signal to the FIFO 34-2 and an inverted field select signal to the FIFO 34-1 via an inverter 36 for alternately enabling the FIFOs for storing the even and odd video fields, respectively. In some video formats, such as RGB and Y, $C_R$, $C_B$, a pair of FIFOs may be used for each of three primary components involved. The plurality of FIFOs 34 store the video data in response to a video pixel clock from the control processor 28. Alternatively, the scan line buffer 34 may be a static random access memory (SRAM) and an address generator.

The shared frame buffer 18 stores the video data in response to a graphics pixel clock from the graphics processor 12. The shared frame buffer 18 also provides the video data to the FIFOs 34. The plurality of FIFOs 34 and the shared frame buffer 18 each provide video data to an arithmetic logic unit (ALU) 38 which interpolates the scan lines of video data from the FIFO 34 and the shared frame buffer 18, as later described herein. The arithmetic logic unit 38 provides the interpolated scan lines of video data to the multiplexer 26, in response to control signals from the control processor 28. The shared frame buffer 18 provides both graphics data and video data to the delay circuit 25 for equalizing the delay in the data path from the shared frame buffer 18 to the multiplexer and the data path through the arithmetic logic unit 38. The delay circuit 25 provides the delayed video data to the multiplexer 26. If the video is switched between being compensated and not being compensated, the delay circuit 25 similarly equalizes the delay path of the data to eliminate jumping of the video. In response to a compensation signal having a first logic state indicating the video data is to be compensated, the multiplexer 26 provides the video data from the arithmetic logic unit 38 to the digital-to-analog converter 30. On the other hand, in response to the compensation signal having a second logic state indicating the video is not to be compensated, the multiplexer 26 provides the video from the shared frame memory 18 (as delayed by the delay circuit 25) to the digital-to-analog converter 30.

Figure 3:
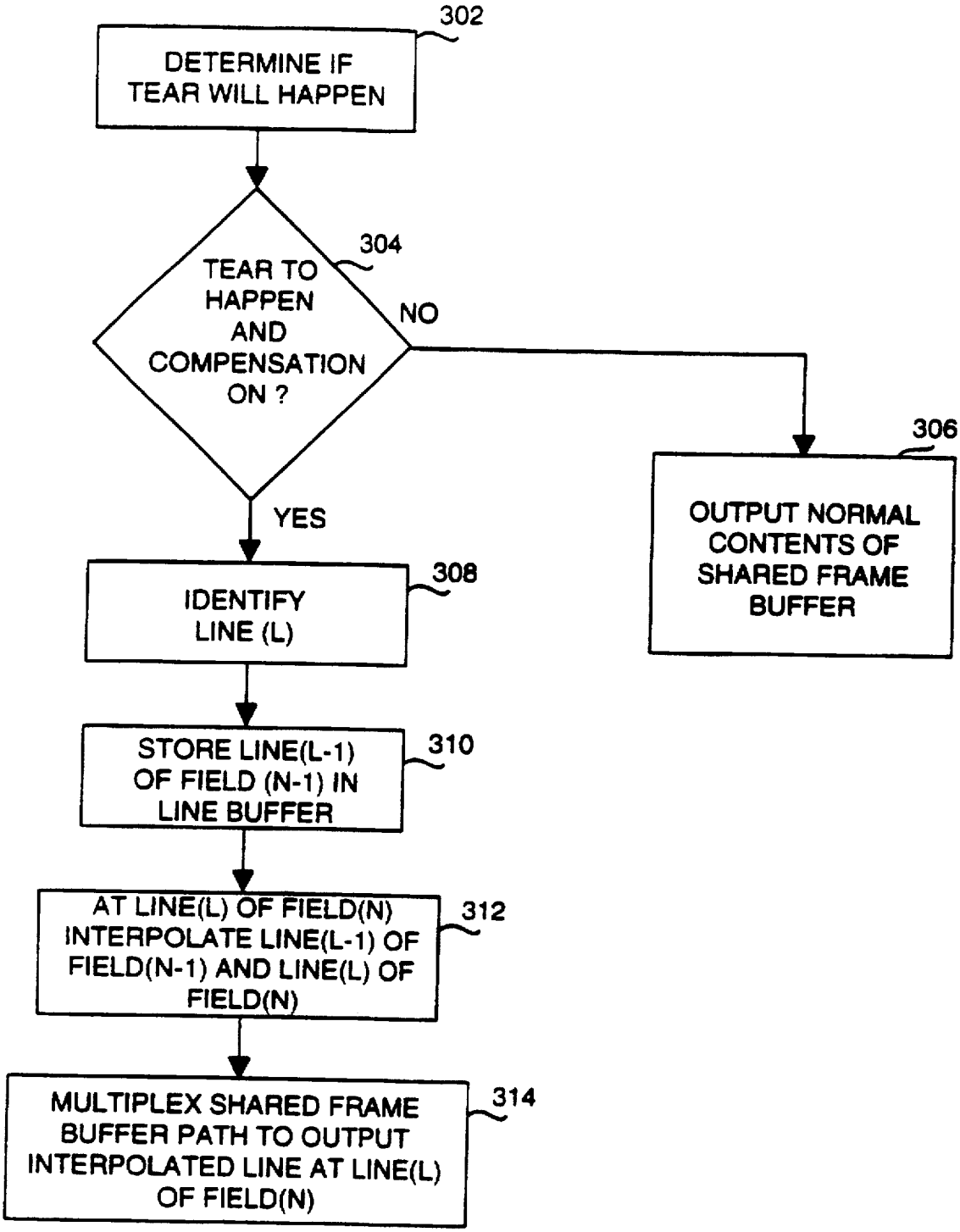
FIG. 3 is a flowchart illustrating the steps employed in correcting the video tearing displayed on a graphics monitor that is associated with a shared frame buffer for storing both video and graphics data according to principles of the invention.

Referring to FIG. 3, there is illustrated a flowchart showing the operation of the display system for compensating for the video tear. The control processor 28 determines 302 whether a tear will occur while displaying the video data. A video tear occurs when the graphics data is read from the shared frame buffer 18 before the video data of the current field is completely stored in the shared frame buffer 18.

Figure 4:
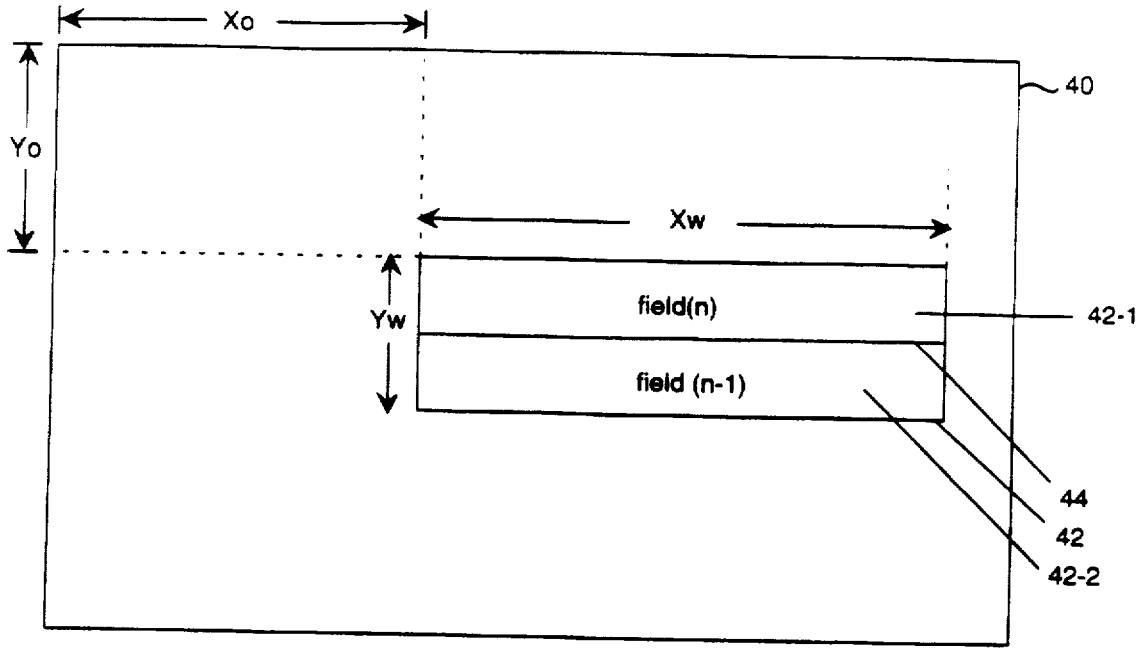
FIG. 4 is a schematic diagram illustrating the format of the video and graphics displayed on a graphics monitor for the display system of FIG. 1.

Referring to FIG. 4, there is illustrated the format of the video and graphics displayed on the monitor 32. The graphics and video data are displayed on a screen 40 of the monitor 32. The video data is displayed in a window 42 having a length $X_w$ and a height $Y_w$. The window 42 has a corner at a horizontal distance $X_o$ (in pixels) and a vertical distance $Y_o$ (in pixels or scan lines) from the upper left corner of the screen 40. A scan line of overtake 44 occurs when the graphics data being read from the shared frame buffer 18 overtakes the storing of the video data of field (n) in the shared frame buffer 18. The scan line of overtake 44 divides the window into a top window 42-1 and a bottom window 42-2. The scan line of overtake 44 is at scan line (L) of field (n). Unless compensated for, the data being displayed in the top window 42-1 is from the current video field (n). The data being displayed in the bottom window 42-2 and in the scan line of overtake 44 is from the previous video field (n-1).

The control processor 28 calculates the scan line of overtake 44 using the resolution of the video, the resolution of the graphics, the window size and position, and the synchronization signals for the video and for the graphics as follows. The video pixel rate (VPR) for storing video data into the shared frame buffer 18 equals the video resolution divided by the video refresh time (or alternately the reciprocal of the video refresh rate). The video resolution is the product of the horizontal pixel resolution of the video source 20 and the vertical pixel resolution of the video source 20. The video data that is to be displayed is stored into the shared frame buffer 18 every display period or refresh period. In an NTSC format, the video data is stored once every field or every 1/59.94 second (16.68 milliseconds). Similarly, the graphics pixel rate (GPR) for storing graphics data into the shared frame buffer 18 equals the graphics resolution divided by the graphics refresh time (or alternately the reciprocal of the graphics refresh rate). The graphics resolution is the product of the horizontal pixel resolution of the graphics and the vertical pixel resolution of the graphics.

The overtake occurs when the reading of the graphics data (the graphics pixel rate times the time of the overtake) equals the storing of the video data (video pixel rates the time of the overtake) plus the offset of the window. Consequently, the time of the overtake ($T_{overtake}$) is calculated using equation (1) as follows:

$$T_{overtake} = \frac{OFFSET}{GPR - VPR} \tag{1}$$

where OFFSET is the number of pixels of graphics data displayed on the screen 40 before the window 42 is displayed and is calculated using equation (2), later described herein, GPR is the graphics pixel rate, and VPR is the video pixel rate. The offset is defined as follows:

$$OFFSET = G_x(Y_o - 1) + X_o \tag{2}$$

where $G_x$ is the horizontal graphics resolution, $Y_o$ is the number of the scan line of the window, earlier described herein, and $X_o$ is the horizontal distance (in pixels) of the window, as earlier described herein. The linear pixel location of the overtake is defined as follows:

$$\text{Pixel location} = VPR \times T_{overtake} \tag{3}$$

where VPR is the video pixel rate, earlier described herein, and $T_{overtake}$ is defined by equation (1).

The linear pixel location of the overtake is converted into a scan line of video of the overtake by dividing the linear pixel location by the horizontal video pixel resolution.

Referring again to FIG. 3, although a tear may occur, it may be desirable not to compensate for the tear. If either video tearing does not occur or the video tearing is not be compensated for 304, the control processor 28 reads 306 the scan lines of video data from the shared frame buffer 18 and sends a compensation signal having a second logic state indicating the video is not to be compensated to command the multiplexer 26 to provide the read scan lines of video data to the digital-to-analog converter 30.

On the other hand, if both a tear occurs and it is to be compensated for 304, the control processor 28 identifies 308 the scan line (L) of field (n) at which the tear occurs. The control processor 28 stores 310 the video data for the scan line before the tear, scan line (L-1) of the previous field (n-1), in the FIFO 34. Alternatively the video data for additional scan lines may be stored into the FIFO 34. For example, scan lines (L-2) and (L-3) of the previous video field (n-1) may be stored in the FIFO 34. At scan line (L) of field (n), the arithmetic logic unit 38 interpolates 312 the video data of scan line (L-1) of field (n-1) and the video data of scan line (L) of field (n). The interpolation may be done as a simple average of a pixel of the scan line (L) of field (n) and a corresponding pixel of the scan line (L-1) of field (n). Mathematically, the interpolation is expressed as:

$$\text{Interpolated pixel } x_{(L)(n)} = \frac{\text{Pixel } x_{(L-1)(n-1)} + \text{Pixel } x_{(L)(n)}}{2} \tag{4}$$

where $\text{Pixel}\times_{(i)(j)}$ is the value of the pixel x at scan line (i) of field (j).

Alternatively, more scan lines of the previous field (n-1) may be used for interpolating using a weighted average. Mathematically, the interpolation is $$\text{Interpolated pixel } x_{(L)(n)} = \frac{1}{k+1}\left[ w_L \text{ Pixel } x_{(L)(n)} + \sum_{m=1}^{k} w_{L-m} \text{ Pixel } x_{(L-m)(n-1)} \right] \tag{5}$$

where $\text{Pixel}\times_{(i)(j)}$ is the same as defined above for equation (4), $w_i$ is the weight assigned to the scan line i of video, and k is the number of scan lines of video data from the previous field that are used for interpolation.

At scan line (L), the control processor 28 provides a compensation signal having a first logic state indicating the video data is to be compensated to the multiplexer 26. In response thereto, the multiplexer 26 provides 314 the interpolated video data from the arithmetic logic unit 38 to the digital-to-analog converter 30. For other scan lines, the control processor 28 provides a compensation signal having a second logic state indicating the video data is not to be compensated. In response thereto, the multiplexer 26 provides noninterpolated video data from the shared frame buffer 18 to the digital-to-analog converter 30 for conversion into a format suitable for display on the monitor 32.

Therefore, the video and graphics display system determines the occurrence of an overtake of reading graphics data from a memory at a rate faster than storing video data into the memory and provides an interpolated scan line of video data to correct the video tearing that occurs at the overtake.

I claim:

1. A method for correcting video tearing in a non-interlaced display system comprising a memory for storing graphics data and video data, the video data being arranged in video fields of scan lines of pixel data, the method comprising the steps of:

writing scan lines of pixel data into the memory at a first selected rate;

reading scan lines of pixel data from the memory at a second selected rate;

determining a scan line of overtake of reading video data from the memory if the second selected rate is faster than the first selected rate;

determining whether the read scan line is the scan line before the scan line of overtake; and interpolating at least one scan line of video data from a video field currently being written in the memory and that ends one scan line before the scan line of overtake and at least one scan line of video data from a video field last written in the memory and that ends one scan line before the scan line of overtake.

2. The method of claim 1 further comprising the steps of:

storing at least one scan line of video from the video field last stored in the memory that ends one line before the scan line of overtake;

displaying the current video field, except, in response to the occurrence of the scan line of overtake, displaying at least one interpolated scan line of video data;

displaying read scan lines of video data from the video field currently being written in the memory that are scan lines above the at least one interpolated scan line of video data;

displaying the at least one interpolated scan line of video data, in response to the occurrence of the scan line of overtake; and displaying read scan lines of video data from the video field last written in the memory that are scan lines below the at least one interpolated scan line of video data.

3. The method of claim 1 wherein the step of interpolating further comprises the step of calculating a weighted average of said at least one scan line of video data from the video field currently being written in the memory and that ends one scan line before the scan line of overtake and said at least one scan line of video data from the video field last written in the memory and that ends one scan line before the scan line of overtake.

4. The method of claim 1 wherein the step of determining a scan line of overtake includes the step of determining the location of the overtake.

5. The method of claim 1 wherein the step of determining a scan line of overtake includes the step of determining a pixel location of the scan line of overtake.

6. Apparatus for providing video and graphics data to an external display system, the display system comprising a monitor, a graphics processor for generating graphics data, a memory coupled to the graphics processor for storing the graphics data at a first selected rate and for storing video data from an external video source at a second selected rate, and a multiplexer having a first input coupled to the memory, having a second input, and having an output coupled to the monitor for supplying data applied to the first input of the multiplexer in response to a selection signal having a first logic state, and for supplying data applied to the second input of the multiplexer in response to a selection signal having a second logic state, the video data being arranged in video fields comprising scan lines of pixel data, the apparatus comprising:

a control processor having a first input coupled to the external video source and having a second input coupled to the graphics processor and for determining the scan line of overtake of reading graphics data from the memory if the first selected rate is faster than the second selected rate of storing video data into the memory and for generating the selection signal having the first logic state indicative of either no scan line of overtake or the scan line being read is not the line of overtake and having the second logic state indicative of a scan line of overtake; and a generator having an input coupled to the external video source and having an output, coupled to the second input of the multiplexer, for supplying at least one scan line of video data that is an interpolation of at least one scan line of video data from the video field currently being stored in the memory and that ends one scan line before the scan line of overtake and of at least one scan line of video data from a video field last stored in the memory and that ends one scan line before the scan line of overtake.

7. The apparatus of claim 6 wherein the control processor determines the location of the scan line of overtake.

8. The apparatus of claim 6 wherein the control processor determines a pixel location of the scan line of overtake.

9. A video and graphics circuit for providing video and graphics data to a computer system for displaying such data on an external display and for receiving video data from an external video source, the computer system having a system processor and having a system memory, each coupled to a bus, the video data being arranged in video fields comprising scan lines of pixel data, the circuit comprising:

a graphics processor having an input for coupling to the bus and having an output for supplying graphics data in response to data received over the bus from the system processor or the system memory;

a buffer having a first input coupled to the output of the graphics processor and having a second input for receiving video data from the external video source and for storing graphics data at a first selected rate and for storing video data at a second selected rate;

a control processor having a first input for coupling to the external video source and having a second input coupled to the graphics processor and for determining the scan line of overtake of reading graphics data into the buffer if the first selected rate is faster than the second selected rate of storing video data of a current video field into the buffer and for generating a selection signal having a first logic state indicative of either no scan line of overtake or the scan line being read is not the line of overtake and having a second logic state indicative of a scan line of overtake;

a video data generator having an input for coupling to the external video source and having an output for supplying at least one scan line of video data as an interpolation of at least one scan line of video data from the video field currently being stored in the buffer and of at least one scan line of video data from a video field last stored in the buffer; and a multiplexer having a first input coupled to the buffer, having a second input coupled to the output of the generator, and having an output for coupling to the external display and for supplying scan lines of video data from the buffer to the output of the multiplexer in response to the selection signal being in the first logic state, and for supplying the at least one interpolated scan line of video data from the video data generator to the output of the multiplexer in response to the selection signal being in the second logic state.

10. The video and graphics circuit of claim 9 wherein the control processor determines the location of the scan line of overtake.

11. The video and graphics circuit of claim 9 wherein the control processor determines a pixel location of the scan line of overtake.

12. A computer system for displaying video data from an external video source and graphics data, the video data being arranged in video fields comprising scan lines of pixel data, the system comprising:

a bus;

a system processor coupled to the bus;

a system memory coupled to the bus;

a display;

a graphics processor having an input for coupling to the bus and having an output for supplying graphics data in response to data received over the bus from the system processor or the system memory;

a buffer having a first input coupled to the output of the graphics processor and having a second input for receiving video data from the external video source and for storing graphics data at a first selected rate and for storing video data at a second selected rate;

a control processor having a first input for coupling to the external video source and having a second input coupled to the graphics processor and for determining the scan line of overtake of reading graphics data from the buffer if the first selected rate is faster than the second selected rate of storing video data of a current video field into the buffer and for generating a selection signal having a first logic state indicative of either no scan line of overtake or the scan line being read is not the line of overtake and having a second logic state indicative of a scan line of overtake;

a video data generator having an input for coupling to the external video source and having an output for supplying at least one scan line of video data as an interpolation of at least one scan line of video data from the video field currently being stored in the buffer and of at least one scan line of video data from a video field last stored in the buffer; and a multiplexer having a first input coupled to the buffer, having a second input coupled to the output of the video data generator, and having an output coupled to the display, and for supplying scan lines of video data from the buffer to the output of the multiplexer in response to the selection signal being in the first logic state, and for supplying the at least one interpolated scan line of video data from the generator to the output of the multiplexer in response to the selection signal being in the second logic state.

13. The computer system of claim 12 wherein the control processor determines the location of the scan line of overtake.

14. The computer system of claim 12 wherein the control processor determines a pixel location of the scan line of overtake.

* * * * *